US010470249B2

(12) United States Patent
Hu et al.

(10) Patent No.: US 10,470,249 B2
(45) Date of Patent: Nov. 5, 2019

(54) BUS BAR ATTACHMENT FOR CARBON NANOTUBE HEATERS

(71) Applicant: Goodrich Corporation, Charlotte, NC (US)

(72) Inventors: Jin Hu, Hudson, OH (US); Galdemir Cezar Botura, Akron, OH (US)

(73) Assignee: Goodrich Corporation, Charlotte, NC (US)

( * ) Notice: Subject to any disclaimer, the term of this patent is extended or adjusted under 35 U.S.C. 154(b) by 460 days.

(21) Appl. No.: 15/270,993

(22) Filed: Sep. 20, 2016

(65) Prior Publication Data

US 2018/0084611 A1 Mar. 22, 2018

(51) Int. Cl.

*H05B 3/14* (2006.01)
*H05B 3/06* (2006.01)
*H05B 3/20* (2006.01)

(52) U.S. Cl.

CPC ..... *H05B 3/145* (2013.01); *H05B 3/06* (2013.01); *H05B 3/20* (2013.01); *H05B 2203/011* (2013.01); *H05B 2203/017* (2013.01); *H05B 2214/04* (2013.01)

(58) Field of Classification Search

CPC ..... H05B 3/145; H05B 2214/04; H05B 2203/017; H05B 2203/011

USPC ..... 219/202, 203, 553; 428/220, 336

See application file for complete search history.

(56) References Cited

U.S. PATENT DOCUMENTS

| | | | | |
|---|---|---|---|---|
| 5,344,696 | A * | 9/1994 | Hastings | B32B 7/02 428/220 |
| 8,752,279 | B2 | 6/2014 | Brittingham et al. | |
| 9,309,001 | B2 | 4/2016 | Calder et al. | |
| 2009/0042455 | A1* | 2/2009 | Mann | H01B 1/24 439/874 |
| 2012/0043415 | A1* | 2/2012 | Limmack | B64D 37/32 244/1 A |
| 2014/0014640 | A1* | 1/2014 | Calder | B64D 15/12 219/202 |
| 2015/0076137 | A1* | 3/2015 | Kim | H05B 3/20 219/553 |
| 2016/0013392 | A1* | 1/2016 | Takahashi | H01L 35/22 438/54 |

FOREIGN PATENT DOCUMENTS

| | | | |
|---|---|---|---|
| EP | 2390182 | A2 | 11/2011 |
| WO | WO2008091001 | A2 | 7/2008 |

OTHER PUBLICATIONS

Extended European Search Report for EP Application No. 17192195.0, dated Feb. 12, 2018, 8 Pages.

* cited by examiner

*Primary Examiner* — Thien S Tran
(74) *Attorney, Agent, or Firm* — Kinney & Lange, P.A.

(57) ABSTRACT

Disclosed is an attachment between a bus bar and a nano-carbon heater used for de-icing and/or anti-icing in an aircraft or other vehicle. The attachment between the bus bar and the heater is created through a coupling agent, a pre-preg glass fabric, and a conductive adhesive. This attachment allows for electrical connections to be made to the heater via the bus bar, and the attachment is strong enough to withstand stress from thermal cycles.

14 Claims, 3 Drawing Sheets

BUS BAR ATTACHMENT FOR CARBON NANOTUBE HEATERS

BACKGROUND

Carbon nanotubes (CNTs) are allotropes of carbon having a generally cylindrical nanostructure, and have a variety of uses in nanotechnology, electronics, optics and other materials sciences. CNTs are both thermally and electrically conductive. Due to these properties, CNTs can be used as heaters to prevent icing on aircraft or other vehicles. Other carbon allotropes, such as graphene or graphene nanoribbons (GNRs), can also be used for heating or de-icing. Graphene has a two-dimensional honeycomb lattice structure, and is much stronger than steel, but is still electrically and thermally conductive. GNRs are strips of graphene with ultra-thin widths. Carbon allotrope heaters are uniquely beneficial for de-icing because of their high efficiency, light weight and ability to be molded into specific shapes, and durability.

The application of heaters made of CNTs, graphene or GNRs to aircraft is complicated by the necessity of connecting the heaters to a power source. Carbon allotropes cannot be wired via soldering to a power source. Generally, CNT heaters are mechanically attached to a metallic bus bar, which in turn is wired to electronics that can provide energy or record data. Previously, other types of heaters that could be more easily attached to a bus bar or electronics were preferred; or carbon allotrope heaters were attached to electronics through mechanical methods such as clamps. These methods did not provide for solderable wire connections to carbon allotrope heaters, and allowed wiring attachments to be delaminated due to coefficient of thermal expansion (CTE) mismatch in thermal cycling environments.

SUMMARY

A heating assembly includes a bus bar, a nano-carbon heater, a conductive adhesive, wherein the conductive adhesive connects the bus bar to the nano-carbon heater, and a pre-preg layer covering the heater and the bus bar.

A method of making a heating assembly includes perforating a portion of a bus bar; treating the bus bar with a coupling agent; applying a conductive adhesive to the bus bar, wherein the coupling agent forms covalent bonds between the bus bar and the conductive adhesive; attaching a nano-carbon heater to the bus bar with the conductive adhesive; attaching a pre-preg glass fabric to the bus bar; and curing the bus bar and nano-carbon heater such that the bus bar is attached to the pre-preg glass fabric and the conductive adhesive.

DETAILED DESCRIPTION

The recited heater assembly allows for soldered wire connections to be made on carbon nanotube (CNT) and other carbon allotrope heaters. These connections are essential for efficient functioning of heaters. Moreover, the assembly allows for a CNT heater-to-bus bar connection that uses an adhesive instead of mechanical means, which minimizes delamination due to mechanical and thermal stresses.

Figure 1:
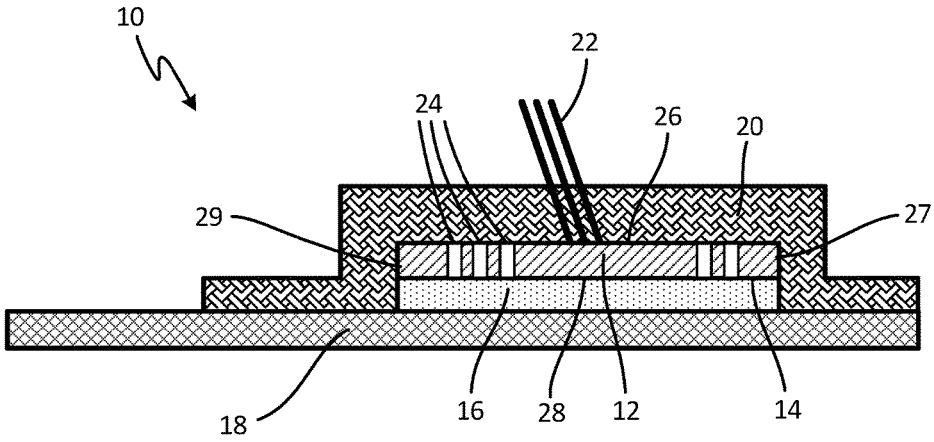
FIG. 1 is a cut-away side view of a heater assembly.

FIG. 1 shows heater assembly 10 from a cut-away side view. Assembly 10 includes bus bar 12, coupling agent 14, conductive adhesive layer 16, nano-carbon heater 18, and pre-preg glass fabric 20. Bus bar 12 is connected to nano-carbon heater 18 through conductive adhesive layer 16. Pre-preg glass fabric 20 is attached to bus bar 12 on the side opposite nano-carbon heater 18.

Figure 2:
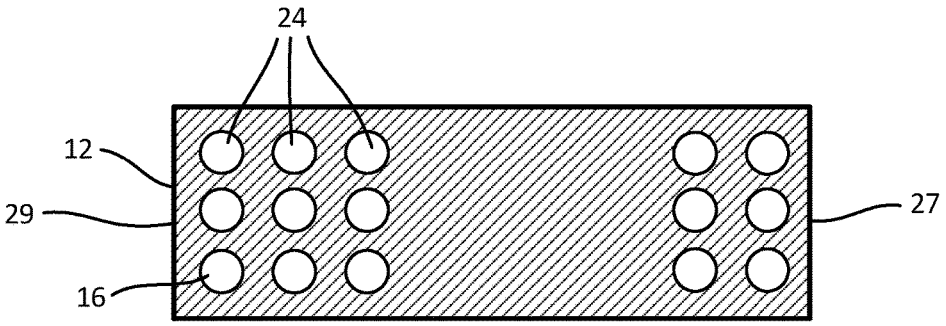
FIG. 2 is a top view of a bus bar.

Bus bar 12 is a metallic strip or bar that conducts electric current. Bus bar 12 may be made of copper, brass, or other appropriate conductive metals or alloys. In FIGS. 1 and 2, bus bar 12 has first edge 27 and second edge 29. Adhesion of bus bar 12 to conductive adhesive layer 16 can be reinforced with bus bar surface treatment of coupling agent 14.

Coupling agent 14 is applied to bus bar 12 to create chemical bonds between bus bar 12 and conductive adhesive layer 16. Conductive adhesive layer 16 is a thermal cycle resistant adhesive, thus conductive adhesive 16 resists the thermal stress from thermal cycling and conducts electricity. Conductive adhesive layer 16 can be a commercially available adhesive such as an epoxy or Creative Materials 128-4A/B (available from Creative Materials Inc., Ayer, Mass.), as long as the adhesive is thermally resistant and electrically conductive.

Coupling agent 14 can be a silane-based agent. It bonds conductive adhesive layer 16 to bus bar 12 through the creation of chemical bonds. In one embodiment, coupling agent 14 can form R—$R_f$—Si—O-M covalent bonds, where $R_f$ is a reactive functional group in the coupling agent, R is a radical group of conductive adhesive 16 and M is an atom of bus bar 12.

Nano-carbon heater 18 is attached to bus bar 12 by conductive adhesive layer 16. Nano-carbon heater can include carbon nanotubes (CNTs), graphene, graphene nanoribbons (GNRs), or other suitable nano-carbon allotropes. CNTs have generally cylindrical structures, graphene has a two-dimensional honeycomb lattice structure, and GNRs are strips of graphene with ultra-thin widths, but all three allotropes are electrically and thermally conductive, and useful as resistive heating elements.

Nano-carbon heaters are lighter weight than metal heaters, and have lower thermal mass. However, carbon heaters cannot be directly soldered to wires because carbon is not metallic. Thus, nano-carbon heater 18 is attached to bus bar 12 through conductive adhesive layer 16 so that electrical current can pass from bus bar 12 through conductive adhesive 16 to nano-carbon heater 18.

Assembly 10 is covered by pre-preg glass fabric 20 to prevent bus bar delamination and provide a wire harness. Pre-preg glass fabric 20 is a preimpregnated composite glass fiber that has been impregnated with a resin system (typically epoxy). Pre-preg glass fabric 20 can be a commercially available pre-preg glass fabrics. Pre-preg glass fabric 20 allows for assembly 10 to be protected from delamination due to mechanical stresses. Pre-preg glass fabric 20 is attached to the external side of bus bar 12. Bus bar 12 has perforated holes 24 in it, which allow pre-preg glass fabric 20 to stick to conductive adhesive layer 16 via perforated holes 24. Pre-preg glass fabric 20 attaches to conductive adhesive layer 16 that is revealed through perforated holes 24 in bus bar 12. Pre-preg glass fabric 20 covers first and second edges 27, 29, of bus bar 12, and preferably seals all edges of bus bar 12.

Additionally, in a de-icing environment, there is a change in temperature over time. In such an environment, assembly 10 is subject to thermal stresses. Coefficient of thermal expansion (CTE) mismatch between the various materials of assembly 10 results in thermal stress, as the various materials expand and contract at different rates when exposed to temperature change. This can result in mechanical failure of traditional assemblies. In assembly 10, the thermal stress of CTE mismatch is minimized due to the mechanical interlock created by the adhesive bonding between the conductive adhesive 16, pre-preg glass fabric 20, and the bonding of bus bar 12 with conductive adhesive 16.

Wires 22 are soldered to a non-perforated portion of bus bar 12 to create an electrical connection and allow current to pass through bus bar 12 and conductive adhesive layer 16 to nano-carbon heater 18.

FIG. 2 shows bus bar 12 outside of heater assembly 10 from a top-down view. Bus bar 12 in FIG. 2 is the same bus bar 12 shown in FIG. 1, and all components are the same. FIG. 2 shows bus bar 12 close-up without pre-preg glass fabric 20, bus bar 12 having at least one edge. Additionally, FIG. 2 shows perforations 24 in bus bar 12. Once conductive adhesive layer 16 is applied to bus bar 12, conductive adhesive layer 16 is visible through perforations 24. Conductive adhesive layer 16 attaches to pre-preg glass fabric 20 through perforations 24. Thus, pre-preg glass fabric 20 is connected to nano-carbon heater 18 by conductive adhesive 16.

Non-perforated portion of bus bar 12 is used for soldering wires 22 to make an electrical connection. This can be accomplished by creating a hole in pre-preg glass fabric 20 after it has been applied to bus bar 12, or by lifting a portion of pre-preg glass fabric 20 off the non-perforated portion of bus bar 12 and attaching wires 22.

Figure 3:
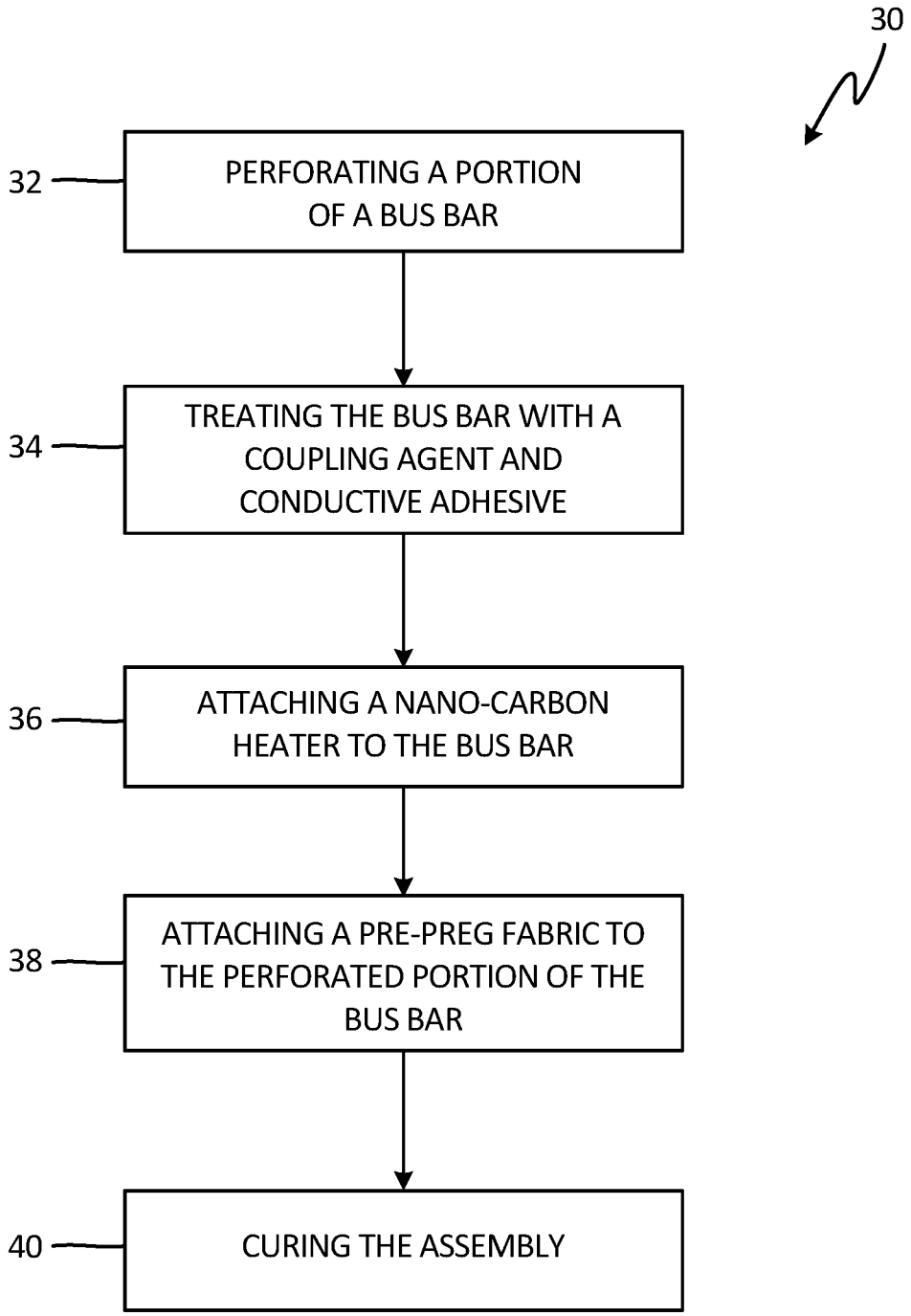
FIG. 3 is flow chart of a method of making a heater assembly.

FIG. 3 is a flow chart depicting method 30 of making heater assembly 10. Method 30 begins with step 32, perforating a portion of a bus bar. A portion of the bus bar should be left un-perforated, as the bus bar will later be soldered to wires. The perforation can be done through ordinary mechanical means, such as drilling or cutting.

Next, the bus bar is treated with a coupling agent in step 34. The coupling agent can be a silane $SiR_fR^1R^2(OR^3)$ compound containing at least one reactive functional group $R_f$ that can react and couple with an adhesive and an alkoxy group that can react and couple with a metal. The bus bar is also treated with a conductive adhesive, such as an epoxy. The coupling agent creates chemical bonds between the bus bar and the conductive adhesive. If an $SiR_fR^1R^2(OR^3)$ compound is used, the bond made is R—$R_f$—Si—O-M bond, where R is a radical of the adhesive and M is an atom of the bus bar.

After the conductive adhesive layer is bonded to the bus bar, a nano-carbon heater is attached to the conductive adhesive layer in step 36. The nano-carbon heater can be made of CNTs, graphene, GNRs, or other appropriate nano-carbon allotropes.

After the heater is attached to the bus bar, a pre-preg glass fabric is attached to the perforated portion of the bus bar in step 38. The pre-preg glass fabric can be a glass fiber based fabric or other commercially available pre-impregnated resin matrix. The pre-preg glass fabric is attached to the conductive adhesive layer through the perforations on the bus bar. The non-perforated portions of the bus bar can be soldered to wires.

Finally, in step 40, the assembly is cured. The pre-preg and conductive adhesive layer require a certain amount of heat and pressure to fully cure and complete the lamination of the heater assembly. The amount of heat and pressure depends on the particular pre-preg and adhesive chosen. Once the assembly is fully cured, the non-perforated bus bar surfaces can be exposed for wiring via soldering. The wired nano-carbon heaters can be used as aircraft electrothermal de-icer and anti-icers.

Heater assembly 10 has a number of benefits. First, nano-carbon heaters are lightweight and have a lighter thermal mass, making them very efficient at converting energy to heat. The nano-carbon heaters may be carbon nanotubes, graphene and graphene nanoribbons, which are all sufficiently lighter than metals or alloys used in traditional heaters.

Second, the connection of a bus bar to a nano-carbon heater allows for soldered wire connections to the heater via the bus bar. Carbon allotropes are not metallic, and therefore cannot be directly soldered to a metallic bus bar. Creating a wire connection to a carbon heater allows for passage of electrical current to and from the carbon heater.

Finally, the assembly avoids delamination due to mechanical and thermal stresses. Heaters on aircraft are subject to two types of stresses: mechanical and thermal. Mechanical stresses, such as vibrations, can physically disrupt the lamination layer and cause deterioration and instability long term. Additionally, the bus bar and the nano-carbon heater have different coefficients of thermal expansion (CTE); they expand and contract at different rates when exposed to varying temperatures, that generates thermal stress. The use of a pre-preg glass fabric interlocks the perforated bus bar between the conductive adhesive layer and the pre-preg glass fabric, reinforcing the bonding of the bus bar with conductive adhesive via coupling agent. This prevents delamination caused by mechanical and thermal stress.

Discussion of Possible Embodiments

The following are non-exclusive descriptions of possible embodiments of the present invention.

A heating assembly includes a bus bar, a nano-carbon heater, a conductive adhesive wherein the conductive adhesive connects the bus bar to the nano-carbon heater, and a pre-preg layer covering the heater.

The assembly of the preceding paragraph can optionally include, additionally and/or alternatively, any one or more of the following features, configurations and/or additional components:

The assembly includes a coupling agent chemically bonding the bus bar and the conductive adhesive.

The assembly includes at least one wire connected to the bus bar through one or more solder connections.

The nano-carbon heater is a carbon nanotube heater.

The nano-carbon heater is a graphene heater.

The nano-carbon heater is a graphene nanoribbon heater.

The pre-preg layer comprises a plurality of glass fibers.

The pre-preg layer seals one or more edges of the bus bar.

A portion of the bus bar is perforated.

The conductive adhesive is thermally resistant.

A method of making a heating assembly includes perforating a portion of a bus bar; treating the bus bar with a coupling agent; applying a conductive adhesive to the bus bar, wherein the coupling agent forms covalent bonds between the bus bar and the conductive adhesive; attaching a nano-carbon heater to the bus bar with the conductive adhesive; attaching a pre-preg glass fabric to the bus bar; and curing the bus bar and nano-carbon heater such that the bus bar is attached to the pre-preg glass fabric and the conductive adhesive.

The method of the preceding paragraph can optionally include, additionally and/or alternatively, any one or more of the following features, configurations and/or additional components:

The method includes soldering wires onto the bus bar, wherein the wires extend through the pre-preg glass fabric.

The pre-preg layer seals one or more edge of the bus bar.

The conductive adhesive is thermally resistant.

The coupling agent creates R—$R_f$—Si—O-M bonds between the bus bar and the conductive adhesive.

The pre-preg layer comprises a glass fiber fabric.

The nano-carbon heater is a carbon nanotube heater.

The nano-carbon heater is a graphene heater.

The nano-carbon heater is a graphene nanoribbon heater

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A heating assembly comprising:

a metallic bus bar, wherein a portion of the bus bar includes perforated holes;

a coupling agent applied on the metallic bus bar a nano-carbon heater;

a conductive adhesive that is thermal cycle resistant, wherein the conductive adhesive connects the metallic bus bar to the nano-carbon heater by chemically bonding with the coupling agent applied on the metallic bus bar; and a pre-preg layer covering the heater and the metallic bus bar and adhesively bonded to the metallic bus bar with the conductive adhesive revealed through the perforated holes in the bus bar, wherein the pre-preg layer seals one or more edges of the bus.

2. The assembly of claim 1 and further comprising at least one wire connected to the bus bar through one or more solder connections.

3. The assembly of claim 1, wherein the nano-carbon heater is a carbon nanotube heater.

4. The assembly of claim 1, wherein the nano-carbon heater is a graphene heater.

5. The assembly of claim 1, wherein the nano-carbon heater is a graphene nanoribbon heater.

6. The assembly of claim 1, wherein the pre-preg layer comprises a plurality of glass fibers.

7. A method of making a heating assembly, the method comprising:

perforating a portion of a bus bar to form perforated holes in the bus bar;

treating the bus bar with a coupling agent;

applying a thermal cycle resistant conductive adhesive to the bus bar, wherein the coupling agent forms covalent bonds between the bus bar and the conductive adhesive;

attaching a nano-carbon heater to the bus bar with the conductive adhesive;

attaching a pre-preg glass fabric to the bus bar; and curing the bus bar and heater such that the bus bar is attached to the pre-preg glass fabric and the conductive adhesive revealed through the perforated holes in the bus bar.

8. The method of claim 7, and further comprising soldering wires onto the bus bar, wherein the wires extend through the pre-preg glass fabric.

9. The method of claim 7, wherein the pre-preg layer seals one or more edge of the bus bar.

10. The method of claim 7, wherein the coupling agent creates R—$R_f$—Si—O-M bonds between the bus bar and the conductive adhesive, wherein R is a radical of the adhesive, $R_f$ is a reactive functional group, and M is an atom of the bus bar.

11. The method of claim 7, wherein the pre-preg layer comprises a glass fiber fabric.

12. The method of claim 7, wherein the nano-carbon heater is a carbon nanotube heater.

13. The method of claim 7, wherein the nano-carbon heater is a graphene heater.

14. The method of claim 7, wherein the nano-carbon heater is a graphene nanoribbon heater.

* * * * *